US012446714B2

(12) United States Patent
Chon et al.

(10) Patent No.: US 12,446,714 B2
(45) Date of Patent: Oct. 21, 2025

(54) CUSTOMIZABLE COMFORTER AND COVER BEDDING SYSTEM

(71) Applicant: Coop Home Goods, LLC, Pico Rivera, CA (US)

(72) Inventors: Kevin Chon, Pico Rivera, CA (US); Jin Chon, Pico Rivera, CA (US); Debbie Liu, Pico Rivera, CA (US)

(73) Assignee: COOP HOME GOODS, LLC, Pico Rivera, CA (US)

( * ) Notice: Subject to any disclaimer, the term of this patent is extended or adjusted under 35 U.S.C. 154(b) by 381 days.

(21) Appl. No.: 17/949,430

(22) Filed: Sep. 21, 2022

(65) Prior Publication Data

US 2024/0090685 A1 Mar. 21, 2024

(51) Int. Cl.
*A47G 9/02* (2006.01)

(52) U.S. Cl.
CPC ..... *A47G 9/0223* (2013.01)

(58) Field of Classification Search
CPC ..... A47G 9/0261; A47G 9/0207; A47G 9/04; A47G 9/0238; A47G 2009/0269; A47G 9/00

See application file for complete search history.

(56) References Cited

U.S. PATENT DOCUMENTS

| | | | | |
|---|---|---|---|---|
| 2,821,723 | A | 2/1958 | Gluck | |
| 5,070,561 | A * | 12/1991 | Keidser | A47G 9/0284 5/482 |
| 6,032,308 | A | 3/2000 | Chuang | |
| 6,637,054 | B2 * | 10/2003 | Chuang | A47G 9/0261 5/482 |
| 6,854,139 | B2 | 2/2005 | Lamy | |
| 10,285,517 | B2 | 5/2019 | Heiman et al. | |
| 10,945,542 | B2 * | 3/2021 | Muthanandam | A47G 9/0261 |
| 2007/0118988 | A1 | 5/2007 | Ho | |
| 2008/0104751 | A1 * | 5/2008 | Friedland | A47G 9/02 5/502 |
| 2009/0070933 | A1 * | 3/2009 | Hall | A47G 9/02 5/482 |
| 2011/0314605 | A1 | 12/2011 | Deguchi | |
| 2014/0189952 | A1 | 7/2014 | Crispino | |
| 2017/0112292 | A1 * | 4/2017 | Sopher | A47C 21/028 |
| 2018/0092473 | A1 | 4/2018 | Stewart | |
| 2019/0099019 | A1 | 4/2019 | Heiman | |
| 2020/0275790 | A1 | 9/2020 | McMullin | |
| 2020/0323368 | A1 | 10/2020 | Shook | |

* cited by examiner

*Primary Examiner* — David R Hare
*Assistant Examiner* — George Samuel Gines
(74) *Attorney, Agent, or Firm* — Carlson, Gaskey & Olds, P.C.

(57) ABSTRACT

A customizable bedding system includes a comforter with a plurality of buttons, a cover including a compartment for the comforter and a first plurality of button holes corresponding with a location of the plurality of buttons on the comforter. A sheet including a second plurality of button holes is securable to the cover and comforter by the buttons on the comforter.

8 Claims, 7 Drawing Sheets

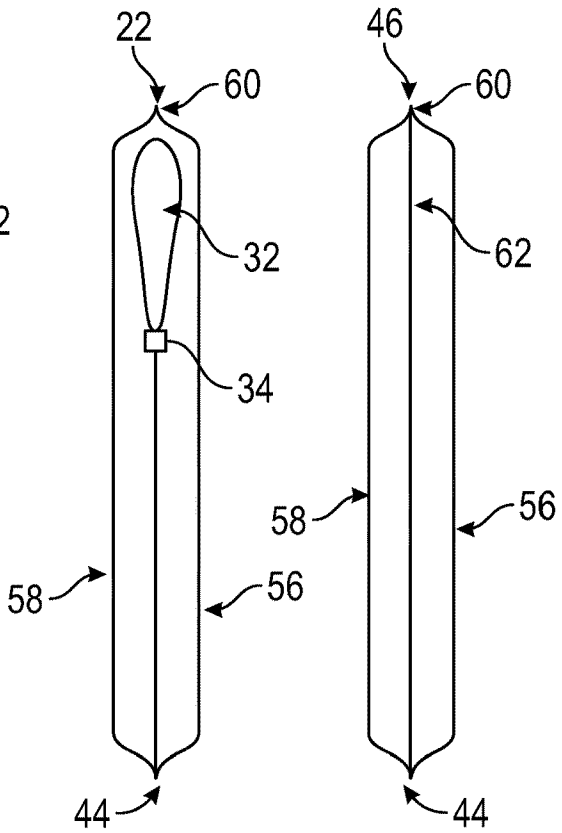
FIG. 5D
FIG. 5C
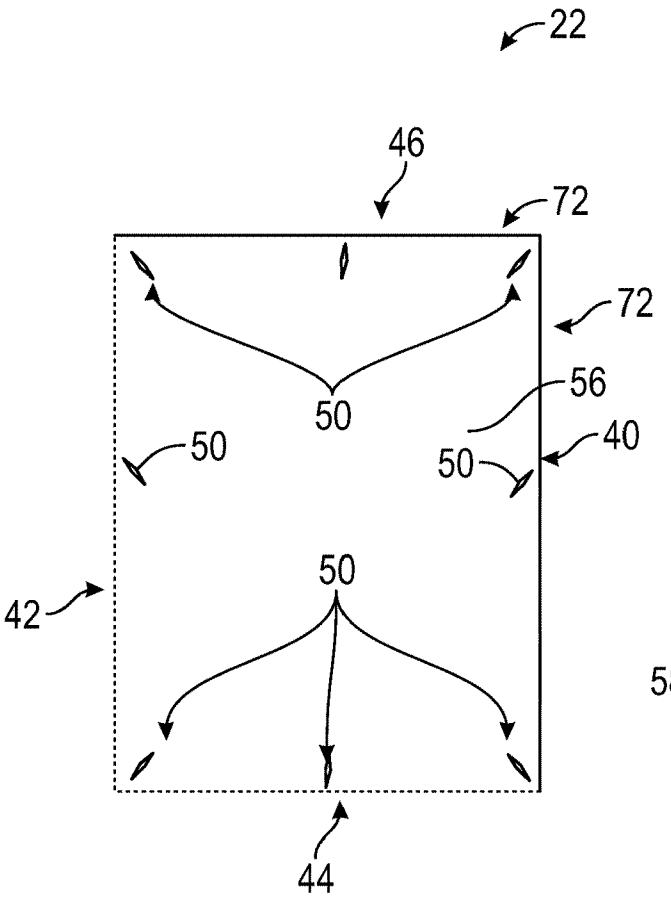
FIG. 5B
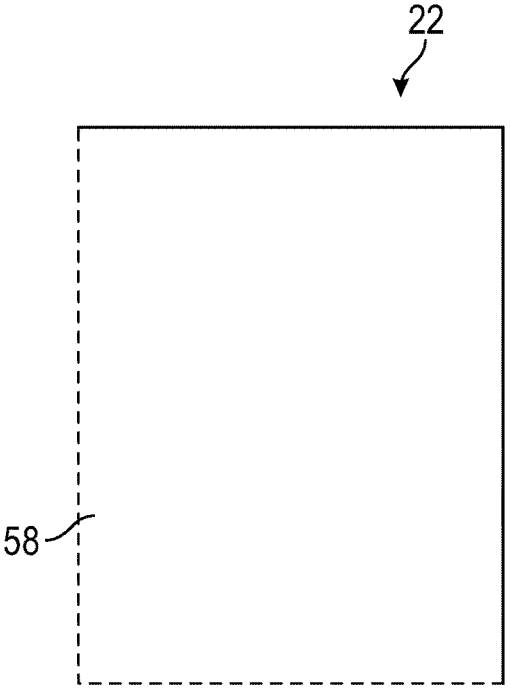
FIG. 5A

CUSTOMIZABLE COMFORTER AND COVER BEDDING SYSTEM

BACKGROUND

Bedding is a general term that is used to describe sheets, pillows, blankets, duvets and other miscellaneous items used to make a bed. Some items are intended for decoration to provide a desired aesthetically pleasing appearance. Other items provide for the comfort of the occupant and a desired sleeping experience. In all versions and combinations, a user will usually make the bed by spreading out the sheets, blankets, comforters in a specific manner. Bedding sets with many different items can require significant amounts of time to arrange and ready for the next night's sleep.

Bedding systems directly impact the quality and quantity of sleep. The specific combination of bedding items that provide a desired sleep environment is unique to everyone. Accordingly, bedding system manufacturers are continually seeking new and innovative bedding systems that ease daily arrangement while also tailoring the sleep experience.

The background description provided herein is for generally presenting a context of this disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A bedding system according to a disclosed example embodiment includes, among other possible things, a comforter including a plurality of buttons, a cover including a compartment for the comforter and a first plurality of button holes corresponding with a location of the plurality of buttons on the comforter, and a sheet including a second plurality of button holes also located to correspond with the location of the plurality of buttons on the comforter. The plurality of buttons secures the cover and sheet to the comforter.

A bedding system according to another disclosed example embodiment includes, among other possible things, a cover including a compartment for a comforter and a first plurality of button holes and a sheet including a second plurality of button holes corresponding with the first plurality of button holes such that the sheet is securable to the cover with buttons extending through the first plurality of button holes and the second plurality of button holes A bedding system according to another disclosed example embodiment includes, among other possible things, a cover including a compartment for a comforter and a first plurality of button holes, a top layer attached to a bottom layer with the compartment disposed therebetween and a zipper located on a first two adjoining sides of the top layer and the bottom layer providing closable access to the compartment Although the different examples have the specific components shown in the illustrations, embodiments of this disclosure are not limited to those combinations. It is possible to use some of the components or features from one of the examples in combination with features or components from another one of the examples.

These and other features disclosed herein can be best understood from the following specification and drawings, the following of which is a brief description.

BRIEF DESCRIPTION OF THE DRAWINGS

FIG. 5A is a top view of an example disclosed cover embodiment.

FIG. 5B is a bottom view of the example disclosed cover embodiment.

FIG. 5C is a side view of the example disclosed cover embodiment.

FIG. 5D is another side view of the example disclosed cover embodiment.

DETAILED DESCRIPTION

Figure 1:
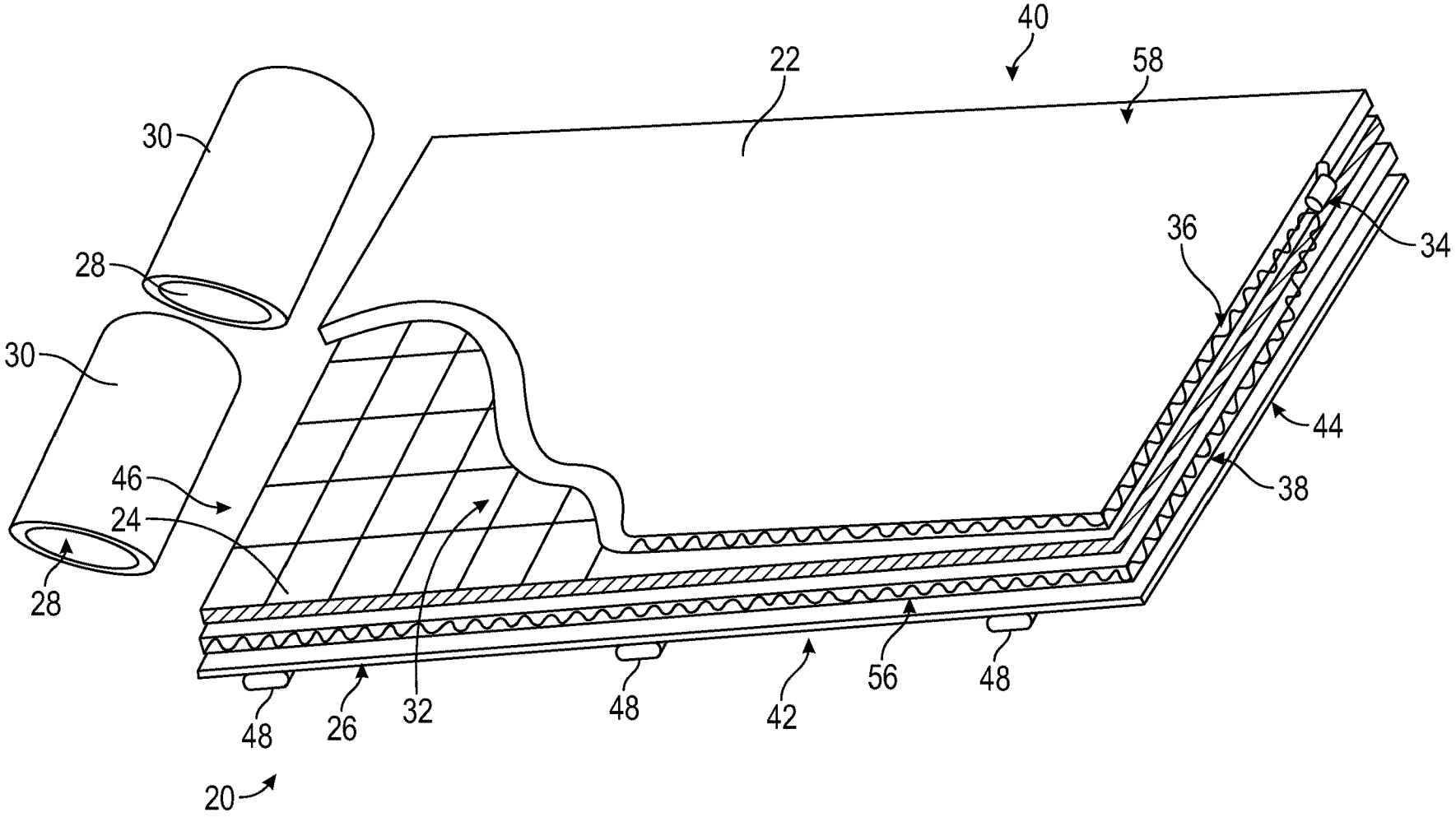
FIG. 1 is a cut-away view of a disclosed bedding system embodiment.
Figure 2:
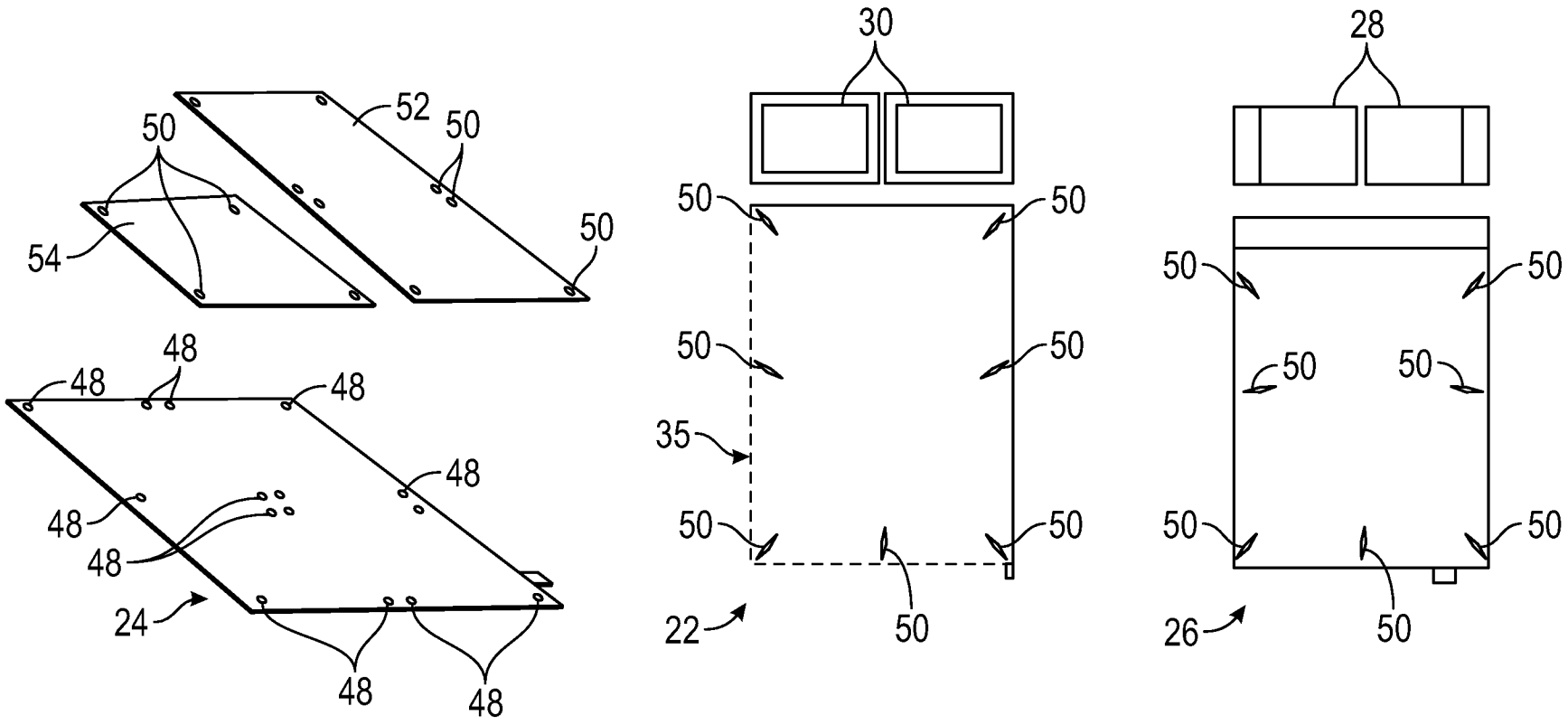
FIG. 2 is a schematic view of separate parts of the disclosed bedding system.

Referring to FIGS. 1 and 2, a disclosed bedding system embodiment is shown and indicated at 20. The example bedding system 20 is customizable to target warmth to an individual's preference and provides for attachment of all parts to ease daily bed arrangement.

The bedding system 20 includes a comforter 24 disposed within a duvet cover 22. The duvet cover 22 attaches to the comforter 24 by way of a plurality of fasteners. In this example embodiment, the fasteners are buttons 48 attached to the comforter 24. The duvet cover 22 includes a plurality of button holes 50 that receive the buttons 48 and secure the comforter 24 within a compartment 32 formed by the duvet cover 22.

A flat sheet 26 is attachable the comforter 24. The flat sheet 26 includes a plurality of button holes 50 that correspond with the location of the button holes in the duvet cover 22 and the buttons 48 of the comforter 24.

Pillow shams 30 may be provided to cover pillows 28 and match the color and aesthetic appearance of the duvet cover 22. As should be appreciated, the pillow shams 30 and duvet cover 22 may be made of any color, texture, fabric with characteristics that provide a desired aesthetic appearance. Many different combinations of color, texture and fabric may be utilized to make the disclosed example bedding system and are all within the scope and contemplation of this disclosure. Moreover, the pillow shams 30, duvet cover 22, comforter 24 and flat sheet 26 may be provided in a coordinated set that provides a desired aesthetic appearance.

The buttons 48 are arranged about a periphery of the comforter 24 and correspond with button holes 50 on each of the duvet cover 22 and flat sheet 26. In one disclosed embodiment, the comforter 24 includes four buttons 48 on each of a top side 46, bottom side 44 and sides 40, 42. Buttons 48 are also located down a middle portion of the comforter 24 to provide for attachment of accessory panels. In the example embodiment, four buttons are arranged in a middle portion of the comforter 24. In another example embodiment, eight buttons are arranged in a middle portion of the comforter 24. It should be appreciated that any number of buttons may be provided on the comforter 24 and located to secure the sheet and additional accessories and are within the contemplation of this disclosure.

In one disclosed example, a half sized accessory panel 52 and quarter panel 54 are attachable to the comforter 24 to tailor the location and insulative properties, and thereby warmth to an individuals' preferences. Each of the accessory panel 52 and quarter panel 54 include button holes 50 that provide for attachment in different locations. Moreover, the accessory panel 52 and the quarter panel 54 are removable to provide seasonal adjustment to an individual's needs. The accessory panel 52 and quarter panel 54 may be a single flat sheet, a thicker thermal layer and/or a weighted panel. Moreover, the material of the half sized accessory panel 52 and/or the quarter panel 54 may be of any material utilized for bedding and remain within the scope and contemplation of this disclosure.

The duvet cover 22 includes a zipper assembly 35 on two adjacent sides to provide for insertion of the comforter 24 into the compartment 32. The zipper assembly 35 includes a zipper pull 34, a first set of teeth 36 attached to a top layer 58 of the duvet cover 22 and a second set of teeth 38 attached to a bottom layer 56 of the duvet cover 22. In this disclosed example, the zipper assembly 35 provides for opening a bottom side 44 and a side 42 to allow insertion of the comforter 24 into a compartment 32 formed between the top layer 58 and the bottom layer 56. Although the example zipper assembly 35 is disposed on the bottom side 44 and one of the side 42, the zipper assembly 35 may be also arranged to open the top side 46 and either of the sides 40, 42 and remain within the scope and contemplation of this disclosure. Opening of two adjacent sides with the zipper assembly 35 eases assembly and insertion of the comforter 24 into the compartment 32 of the duvet cover 22.

The buttons 48 hold the comforter 24 in-place within the compartment 32 in a spread out, even and uniform orientation. The attachment of the comforter 24 within the duvet cover 22 prevents bunching and shifting of the comforter 24 relative to the duvet cover 22.

Figure 3:
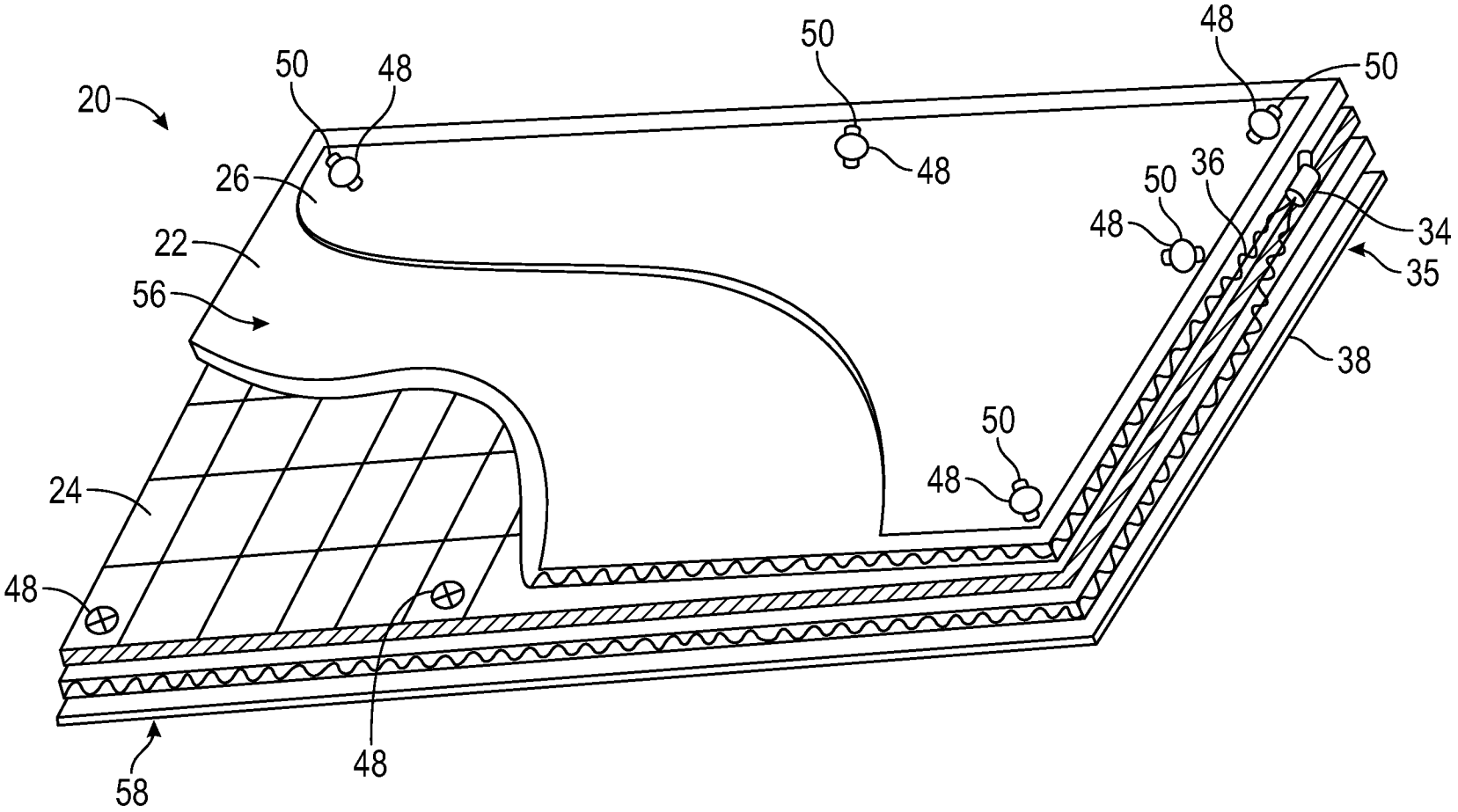
FIG. 3 is a cut-away view of a portion of the disclosed bedding system embodiment.
Figure 4:
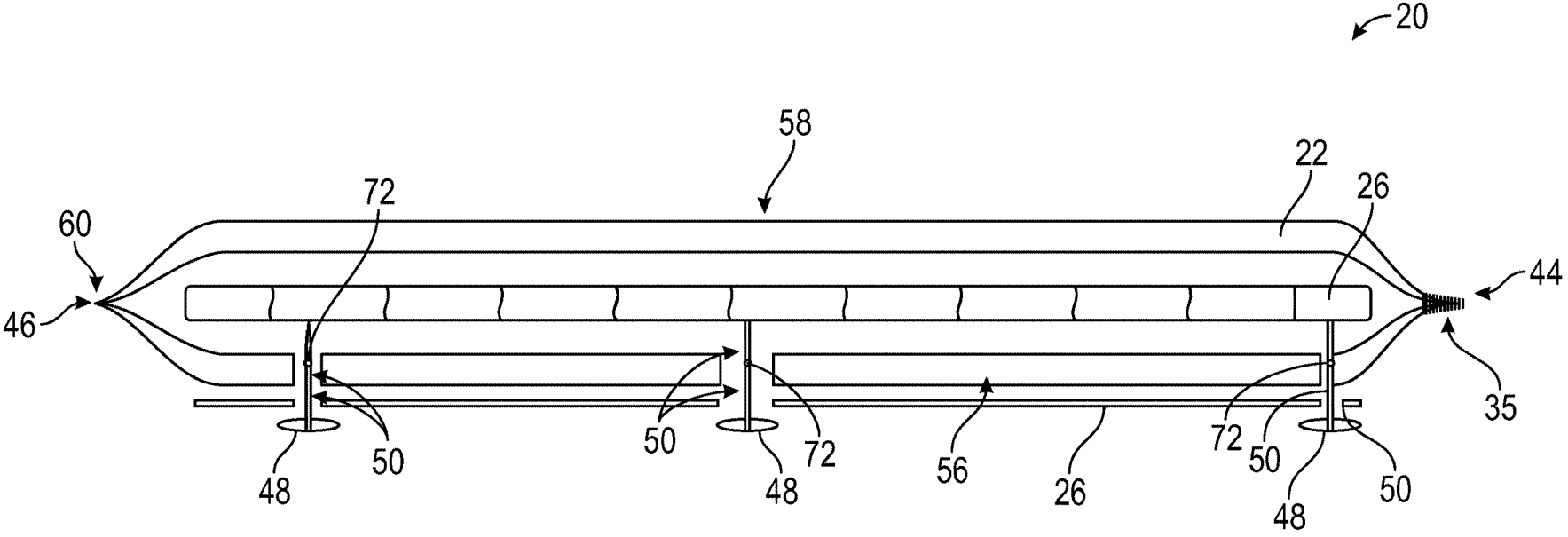
FIG. 4 is a cross-section of a portion of the disclosed bedding system embodiment.

Referring to FIGS. 3 and 4, with continued reference to FIGS. 1 and 2, a bottom side of the bedding system 20 is illustrated and shows the buttons 48 protruding through the bottom layer 56 of the duvet cover 22 and the flat sheet 26. The cut-away portion shows the comforter 24 within the compartment 32 of the duvet cover 22. The buttons 48 are attached only to the comforter 24 and extend through button holes 50 disposed through the bottom layer 56 of the duvet cover 22 and the flat sheet 26. The comforter 24 is enclosed within the compartment 32 by the closing the zipper assembly 35 to secure the bottom side 44 and side 42.

In one disclosed embodiment, only the bottom layer 56 of the duvet cover 22 includes button holes 50. The top layer 58 may therefore, provide an uninterrupted uniform appearance that conceals the buttons 48 securing the comforter 24 to the duvet cover 22 and the flat sheet 26.

The buttons 48 are secured to the comforter by stitching 72 (Shown in FIG. 4). The stitching 72 is of a length that provides for the buttons 48 to extend through both the duvet cover 22 and the flat sheet 26. The stitching may be of any configuration and material commonly utilized for securement to bedding materials.

The top layer 58 is attached to the bottom layer 56 at the top side 46 by a stitched seam 60. The stitched seam 60 provides a permanent attachment and may be formed with any pattern and thread combination utilized to secure adjacent layers.

Referring to FIGS. 5A-D, the example duvet cover 22 is shown independent of the other bedding parts and includes the zipper assembly 35 disposed on the two adjacent sides 44 and 42. The other adjacent sides, 46 and 40 are fastened together by stitching or other fastening process utilized for securement of sheet material.

The example duvet cover 22 includes the button holes 50 only on the bottom layer 56 (FIG. 5B). The top layer 58 (FIG. 5A) is a continuous uniform uninterrupted sheet without button holes 50 The uninterrupted to layer 58 provides a desired appearance. However, it is within the contemplation and scope of this disclosure to provide button holes 50 on the top layer 58.

The example duvet cover 22 is illustrated with the top layer 58 and the bottom layer 56 as sheet material. However, both the top layer 58 and the bottom layer 56 may be formed of multiple sheets with filling therebetween to provide additional insulative properties separate from the comforter 24. The multiple sheets may be formed using baffle box and/or sewn-through construction to form multiple cavities for filling as is known.

The top layer 58 is secured to the bottom layer 56 at the side 40 by a stitched seam 62. The stitched seam 62 provides a permanent attachment and may be formed with any pattern and thread combination utilized to secure adjacent layers. Accordingly, the top layer 58 and bottom layer 56 are secured together at the adjacent top side 46 and side 40 by corresponding stitched seams 60 and 62. The stitching at the seams 60, 62 may be formed using known processes, material, and methods.

Figure 6:
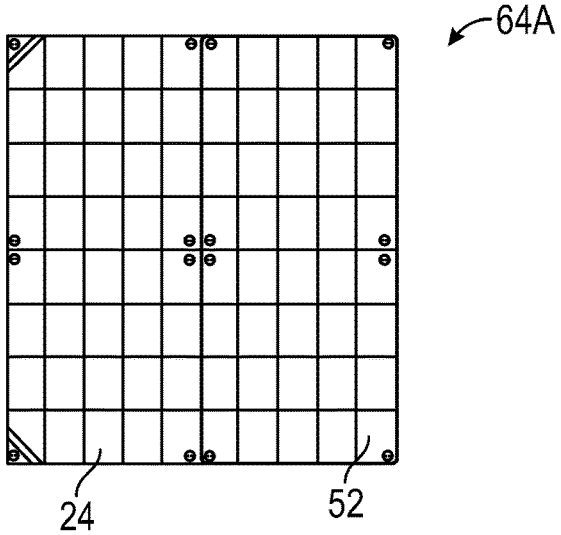
FIG. 6 is a top view of an example comforter embodiment with an attached accessory panel.
Figure 7:
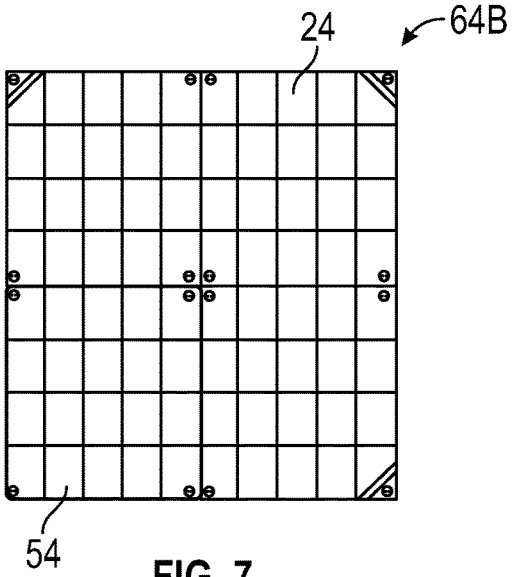
FIG. 7 is a top view an example comforter embodiment with another attached accessory panel.
Figure 8:
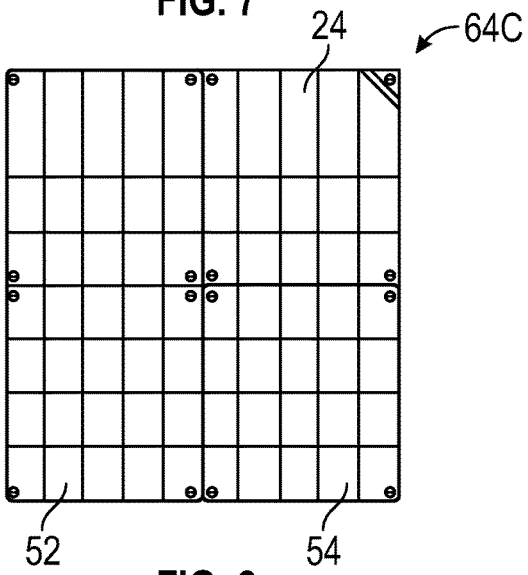
FIG. 8 is a top view of an example comforter embodiment with two attached accessory panels.

Referring to FIGS. 6, 7 and 8, different comforter configurations 64A-C are shown with different combination of the accessory panel 52 and/or the quarter panel 54. The accessory panel 52 and the quarter panel 54 may be attached to the comforter 24 to tailor insulative properties to a specific location. A few possible configurations for the location of the accessory panel 52 and the quarter panel 54 are schematically shown.

In FIG. 6, the comforter configuration 64A includes a single ½ sized accessory panel 52 is attached to one side of the comforter 24. The view shown is of the bottom side of the comforter 24 so that the buttons 48 are visible. Once the accessory panel 52 is attached, the comforter 24 is turned over such that the buttons 48 may be inserted through the bottom layer 56 of the duvet cover 22 as shown in FIG. 3.

FIG. 7 illustrates a comforter configurations 64B with only a quarter panel 54 attached to one location to provide increased warmth at the bottom one side. In the comforter configuration 64B, one person's feet would have increased warmth, while the other sleeper would have the minimal warmth provided by the comforter 24 alone.

FIG. 8 illustrates yet another example comforter configuration 64C. The comforter configuration 64C includes both a ½ sized accessory panel 52 and a ¼ sized quarter panel 54 are attached by buttons 48 to the comforter 24. In the comforter configuration 64C, the comforter 24 adjusts warmth in the desired locations while leaving other parts with minimal warmth to suit each sleeper.

The configurations 64A-C illustrated in FIGS. 6-8 are provided by way of example and are not an exhaustive treatment of all possibilities. More than one accessory panel 52 and/or quarter panel 54 may be attached at any one location to provide even more warmth. Moreover, different combinations of accessory panels 52 and quarter panels 54 could be utilized and are within the contemplation and scope of this disclosure.

In each of the configurations shown in FIGS. 6-8, the comforter 24 and any accessory panel 52 and/or quarter panel 54 is inserted into the compartment 32 of the duvet cover 22. The buttons 48 would therefore extend through the accessory panel 52 and/or quarter panel 54, the bottom layer 56 of the duvet cover 22 and the flat sheet 26. The duvet cover 22, comforter 24 and the flat sheet 26 would, thereby form a single assembly that is simply to arrange. The buttons 48 secure the parts together in a spread-out fashion that would not bunch up or become tangled. However, while the buttons 48 secure the items together, the buttons 48 and buttons holes 50 accommodate movement while sleeping. Additionally, by maintaining the relative orientation and spread out position of the comforter 24 to the duvet cover 22 and flat sheet 26, the desired insulated properties are maintained, regardless of shifting of occupants during sleep. Accordingly, the disclosed example bedding system 20 both accommodates different sleeping preferences and maintains the desired warmth placement.

Figure 9:
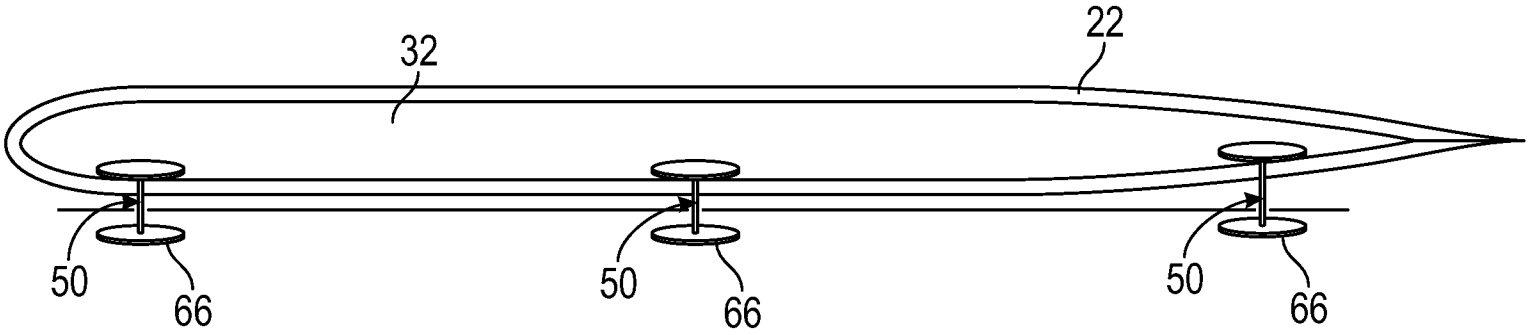
FIG. 9 is a cross-sectional view of another example bedding system embodiment.
Figure 11:
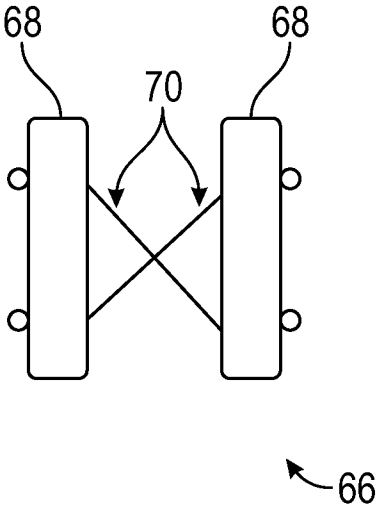
FIG. 11 is a side view of the example button assembly embodiment.
Figure 10:
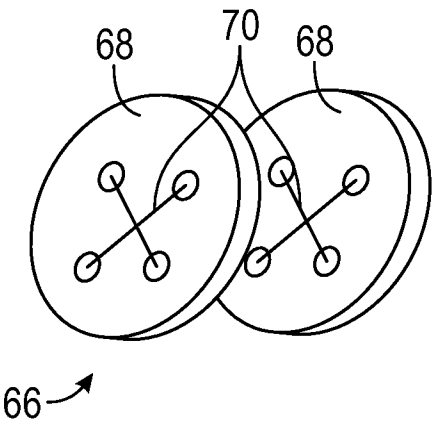
FIG. 10 is a perspective view of an example button assembly embodiment.

Referring to FIGS. 9, 10 and 11, as seasons change and the requirement for warmth changes, the comforter 24 may not be necessary to provide the desired insulative properties and warmth. Without the comforter 24, there are not buttons 48 to secure the flat sheet 26 to the duvet cover 22. A button assembly 66 separate from the comforter 24 is therefore provided. The button assembly 66 includes two buttons 68 secured together by stitching 70. The button assembly 66 is secured to the duvet cover 22 and provides for attachment to the flat sheet 26. A first button 68 is disposed within the compartment 32 of the duvet cover 22. The stitching 70 extends through the button hole 50 and supports the second one of the buttons 68 along the bottom layer 56 of the duvet cover 22. The flat sheet 26 may than be secured to the duvet cover 22 without the comforter 24.

It should be appreciated, that the size, color, texture, and shape of the buttons 68 may vary within the scope and contemplation of this disclosure. In one disclosed example, the buttons 68 are made from wood and include four holes for receiving the stitching. However, other materials and attachment methods may be utilized within the contemplation and scope of this disclosure.

Additionally, although the example button assemblies 66 are shown by example as being used to secure the flat sheet 26 to the duvet cover 22, the button assemblies 66 may be utilized with the comforter 24, the accessory panels 52 and/or the quarter panels 54 to provide desired securement between the various parts of the disclosed example bedding system 20. Accordingly, the button assemblies 66 provide for any number of combinations between the duvet cover 22, flat sheet 26, comforter 24, accessory panels 52 and quarter panels 54 for tailoring insulating properties to an individual's sleeping preferences.

Accordingly, the disclosed example bedding system 20 provides a desired aesthetic appearance, eases daily bedding arrangement, and enables customization of warmth for individual preferences and changes in seasons.

Although the different non-limiting embodiments are illustrated as having specific components or steps, the embodiments of this disclosure are not limited to those combinations. It is possible to use some of the components or features from any of the non-limiting embodiments in combination with features or components from any of the other non-limiting embodiments.

Like reference numerals identify corresponding or similar elements throughout the several drawings. Although a component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A bedding system comprising:

a comforter including a plurality of buttons;

a cover including a compartment for the comforter and a first plurality of button holes corresponding with a location of the plurality of buttons on the comforter; and a sheet including a second plurality of button holes also located to correspond with the location of the plurality of buttons on the comforter, wherein the plurality of buttons secures the comforter to the cover and the sheet to the cover, an accessory panel separate from the cover and the comforter, the accessory panel includes a third plurality of button holes for attachment to the comforter, wherein the accessory panel is attached to the comforter and received within the compartment of the cover.

2. The bedding system as recited in claim 1, wherein the cover includes a top layer attached to a bottom layer with the compartment disposed therebetween and a zipper located on a first two adjoining sides of the top layer and the bottom layer providing closable access to the compartment for inserting the comforter into the cover.

3. The bedding system as recited in claim 2, wherein the first plurality of button holes are disposed in the bottom layer.

4. The bedding system as recited in claim 3, wherein the top layer is stitched to the bottom layer on a second two adjoining sides.

5. The bedding system as recited in claim 4, wherein the top layer of the cover does not include any button holes.

6. The bedding system as recited in claim 4, wherein the plurality of buttons comprises buttons at each corner and at least one button disposed midway between a top edge and a bottom edge.

7. The bedding system as recited in claim 1, wherein the accessory panel is half a width of the comforter and equal in length.

8. The bedding system as recited in claim 1, wherein the accessory panel is a quarter the size of the comforter.

* * * * *